United States Patent [19]

Pierce

[11] 4,079,993

[45] Mar. 21, 1978

[54] BACK REST

[76] Inventor: James E. Pierce, 5 Ash La., Ojai, Calif. 93023

[21] Appl. No.: 711,357

[22] Filed: Aug. 3, 1976

Related U.S. Application Data

[63] Continuation of Ser. No. 569,203, Apr. 18, 1976.

[51] Int. Cl.[2] ..... A47C 7/42

[52] U.S. Cl. ..... 297/352; 297/252

[58] Field of Search ..... 297/352, 252, 443, 285, 297/250, 350; 248/250

[56] References Cited

U.S. PATENT DOCUMENTS

| | | | |
|---|---|---|---|
| 846,904 | 3/1907 | Brady et al. | 297/285 |
| 897,076 | 8/1908 | Eustis | 248/250 |
| 1,468,872 | 9/1923 | Beskow | 297/252 |
| 2,710,646 | 6/1955 | Kirby | 297/350 |
| 2,736,364 | 2/1956 | Janus | 297/250 |
| 2,797,740 | 7/1957 | Cappello | 297/443 X |

FOREIGN PATENT DOCUMENTS

| | | | |
|---|---|---|---|
| 129,832 | 1/1929 | Switzerland | 297/252 |

*Primary Examiner*—Francis K. Zugel
*Attorney, Agent, or Firm*—Peck & Peck

[57] ABSTRACT

A portable back rest, composed of one planar sheet of material adapted particularly, but not exclusively, for use on stadium, or the like, bleacher or plank seats which are not provided with backs. The back rest is of unitary one piece construction and comprises a sheet of material in generally planar configuration which may be stamped or molded into the proper flat configuration for ease of transport and storage. The material from which the back rest is stamped or molded, is flexible so that it may be flexed from its flat transport and storage condition to its operative condition for combination with a bleacher seat. The one piece planar sheet of material from which the back rest is made, has an inherent "memory," or self adjusting characteristic, which urges it at all times to assume its flat transport and storage condition. The back rest is provided with means integral therewith for releasably clamping or locking the back rest in operative position on a bleacher seat. The "memory" or self adjusting characteristic of the sheet from which the back rest is made serves a dual function, it permits bending the back rest for combination with the bleacher seat, and because of this "memory," the releasable clamping or locking means are urged into back rest supporting and maintaining position on the bleacher seat, and this inherent "memory" also functions to automatically return the back rest to its flat transport and storage condition when the clamping or locking means is released from the bleacher seat.

4 Claims, 4 Drawing Figures

BACK REST

This is a continuation, of application Ser. No. 569,203 filed Apr. 18, 1976.

BRIEF SUMMARY OF THE INVENTION

A great many stadiums, arenas, or other sites where spectator events may take place, are often provided solely with bleacher or plank seats which are not provided with backs to make the event being watched more comfortable for the spectator. It has been one of my prime purposes to evolve a back rest for use on such bleacher seats and the like, which are not provided with back supports, so that the seated watching of an event is made more comfortable for the spectator.

While I am aware that back rests of this broad nature have heretofore been devised, such back rests are not easily manipulable by the user thereof, are of a bulky, hard to transport character, and are relatively complex and expensive to produce.

In overcoming the defects which are inherent in such prior back rests, I have provided a back rest which is inexpensive to produce, easy to carry and not bulky to store and is attachable to, and detachable from a bleacher seat with great facility. Actually, no particular skill is required in the manipulation of this backrest into operative back supporting position combined with the bleacher seat and into flat transport and storage condition.

Experience indicates that bleacher seats often vary in their thickness and width, and being fully aware of this dissimilarity in bleacher seats, I have so constructed the back rest of this invention that it will accommodate itself to such bleacher seats having the aforesaid dimensional differences.

To add to the comfort of the user of this back rest, it has been so constructed and designed that the user thereof may cause the back rest to tilt backwards so as to provide a more comfortable and relaxing back supporting medium. This tilting feature of the inventiodn, functions for the purposes for which it was designed on bleacher seats which may have varying dimensions.

In order to obtain the above mentioned and other desirable characteristics and functions which are inherent in the back rest, it is preferably formed by stamping or molding into flat configuration so that it is not bulky, may be easily stored and carried. The stamped or molded sheet from which the back rest is made, is formed with integral means adapted to releasably clamp or lock on the bleacher seat so that the back rest will be combined therewith in proper and desirable back supporting position. The back rest is formed from a material which is flexible and which is endowed with self adjusting, or "memory" characteristics, so that it may be bent or shaped out of its normal flat condition by the user thereof into position so that the releasable clamping or locking means will be connected and releasably locked to the bleacher seat, and will be maintained in this operative locked position due to the inherent "memory" or self adjusting feature of the material. Due to this "memory" characteristic of the material, the releasable clamping and locking means may be removed from their positions associated with the bleacher seat and the back rest will automatically return to its original flat condition.

This back rest provides an aesthetically pleasing, extremely comfortable back supporting means when attached to a bleacher seat or the like. The flexibility of the material from which the back rest is formed, insures that it will conform to the contours of the user's back to thereby provide substantially greater comfort to the user. As will become apparent as this description proceeds, the flat blanked out back rest when it is releasably clamped and located on a bleacher seat is bent or shaped into generally semicircular shape, and the releasable clamping and locking means are snapped over the bleacher seat and when the bending pressure on the back is released, the sheet because of its "memory" trait, will be urged to assume its flat condition thereby causing the releasable clamping and locking means to clamp the back rest on the bleacher seat. The back rest, in this operative condition, forms an eye pleasing modernistic shape and style. It will be appreciated that the back rest may be used with a cushion for the user to sit upon.

Incorporated as an integral part of the single sheet of material of generally planar configuration from which the back rest is formed, is a member which restricts unrestrained and undesired movement of the arm members or side panels.

It is significant, and the fact has not been lost sight of, that it is thought to be highly desirable, that a back rest of this general character may be produced in volume at relatively small expense and involves no complex features of construction or use. The back rest is endowed with enduring characteristics so that under normal usage, it will have a relatively long life, it is light in weight and, therefore, easy to carry and is flat and of substantially no bulk when it is in flat planar condition.

CITATION OF PRIOR ART BY APPLICANT UNDER MPEP 707.05(b)

Attached hereto is a copy of U.S. Pat. No. 2,710,646, which issued on June 14, 1955, to James B. Kirby for PORTABLE SEAT-BACK.

This patent discloses a PORTABLE SEAT-BACK adapted to be removably attached to a plank type bleacher or the like seat. The seat back of this patent is comprised of three sections of moldable material, the back section being hingedly connected to the side sections by means of flexible webbing or the like material so that the seat back, when not in use, may be folded up. The sections or panels comprising the seat back are molded into permanent slightly arcuate condition and the side panels are provided with hooks which are adapted to be releasably locked on the bleacher seat.

The Kirby disclosure provides the three sections or panel members which are preferably formed of fiberglass which is molded into the proper configuration to provide a seat back, and the sections remain permanently in their molded contour.

The applicant's seat back is stamped or molded from any suitable material which is flexible and bendable into seat back configuration, however, the material from which the applicant's seat back is composed is endowed with an inherent "memory" or "snap back" characteristic so that when it is bent and releasably locked on a bleacher seat and then is released therefrom, the inherent "memory" characteristic of the material will cause it to automatically return to flat planar configuration for facilitating the storage and transport thereof. This inherent "memory" characteristic of the material not only functions to automatically return the seat back to its flat planar configuration, but it also constantly urges or biases the bent material toward its flat condition thereby causing the locking means to be releasably clamped to the bleacher seat.

The hooks of the Kirby patent are not integrally formed with the sections or panels 6, 7, 8 and, therefore, in the manufacture of the Kirby back rest, an additional step of fastening such members to the sections or panels is necessary.

It is obvious that the material from which the back rest of the Kirby back rest is formed, does not have an inherent "memory" so that the means for attaching the back rest to the bleacher seat are not constantly biased into releasable clamping position due to the inherent "memory" of the material from which applicant's back rest is composed.

Kirby does not show or suggest any means allowing the back rest to be tilted backward with respect to the bleacher seat. Kirby, likewise fails to disclose or remotely suggest that it would be obvious to provide a sheet of material which is bendable into position for releasably clamping on a bleacher seat and wherein a lip or depending portion extends behind the bleacher seat.

All of the claims in this application are directed to these and other unobvious improvements over Kirby which endow the applicant's invention with features of substantial advantage.

DETAILED DESCRIPTION

Figure 1:
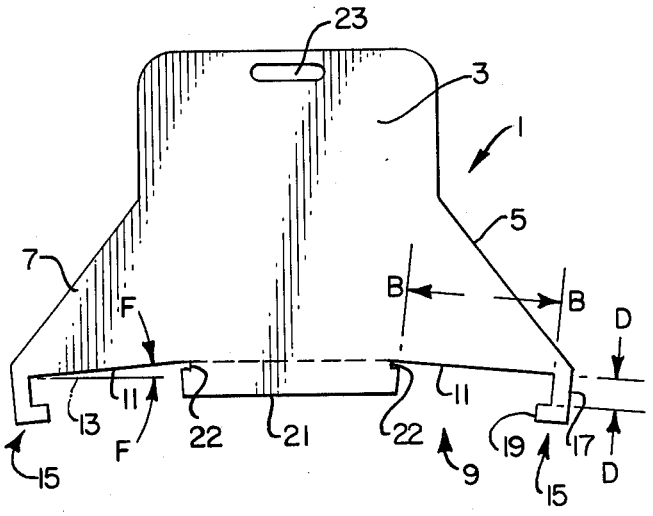
FIG. 1 is a plan view of the back rest in flat transport and storage condition.

In the accompanying drawings, the numeral 1 has been used to designate the back rest in its entirety including various features by means of which it may be combined with a bleacher seat in operative position for the back supporting comfort of the user thereof. The back rest comprises a body section 3 from each side of which a pair, of what I shall term "arm members," or side panels 5 and 7 downwardly diverge. The lower edges of each arm member 5 and 7 are formed at an angle to the horizontal to provide a cutout section 9 at the lower edge of each arm or side panel member. The lower edge 11 of each arm member 5 and 7 is, as stated above, cut at an angle to the horizontal in such a manner that each lower edge 11 extends inwardly and upwardly with respect to the body portion 3 of the back rest. In FIG. 1 of the drawings, the line 13 illustrates the horizontal so that an angle F-F is provided between each lower edge 11 of each arm 5 and 7 and the horizontal 13. The purpose of this angular formation of the lower edges of the arm members will be described in detail hereinafter. Depending downwardly from each outer end of each arm of panel member 5 and 7 is a bleacher seat locking or clamping arrangement designated generally by the numeral 15. Each bleacher seat clamping or locking arrangement comprises a depending integral length 17 of the stock from which the back rest is formed, and at the lower end of each length 17, an inwardly extending clamping foot is provided. This arrangement provides a dimension D-D between the lower edges 11 of each arm member and the upper edges of each clamping foot 19.

The body section 3 is formed with an integral downwardly depending member or lip 21, which extends between the cutout sections 9 and below the edges 11 of the arm of panel members 5 and 7. At the point of juncture between the depending member or lip 21 and each lower edge 11 of the arms 5 and 7, I have provided a unique construction comprising cut outs 22. This construction has been designed to relieve the concentration of stresses at the corners between the lip member 21 and the lower edges 11 of the arms 5 and 7. A carrying handhole or slot 23 is formed in the body section 3 of the back rest in order to facilitate the carrying of the back rest.

As has been set forth above, the back rest comprises a unitary one piece sheet of any suitable material having the described "memory," self adjusting or snap back characteristic. The back rest has a flat configuration when it is in transport and storage condition and because of its inherent flexibility, it may be bent or shaped into a generally semi-circular condition for releasable attachment to a bleacher seat. The back rest may be formed of polyethylene or of many other suitable materials which have the necessary "memory" and the like aforementioned advantageous characteristics. There are a variety of plastics which may be used and which are endowed with the necessary characteristics mentioned above. Certain types of metal also may be used as well as some of the high strength, inexpensive impregnated papers and cardboards which are now available.

The back rest, being of one piece of stock, spreads the loads and stresses along its entire length and presents a smooth and continuous surface to the user's back. It is to be recognized that the back rest of this invention presents a smooth sheet of planar configuration, with no extraneous elements secured thereto and this structured fact is highly advantageous in its production and use.

Figure 2:
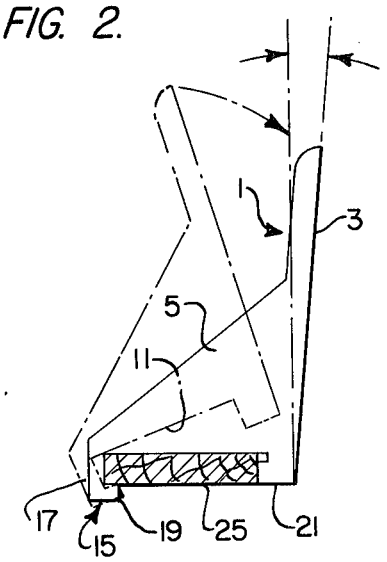
FIG. 2 is a side elevation of the back rest, illustrating it in operative position combined with a bleacher seat and also illustrating in phantom lines the positions the back rest assumes or being combined with and removably attached to a bleacher seat.
Figure 3:
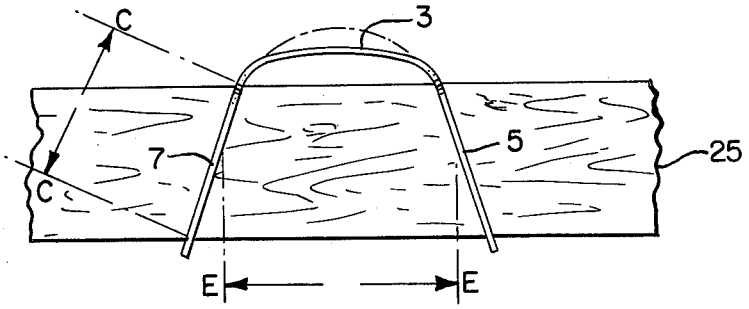
FIG. 3 is a top plan view disclosing the back rest in operative position on a bleacher seat.
Figure 4:
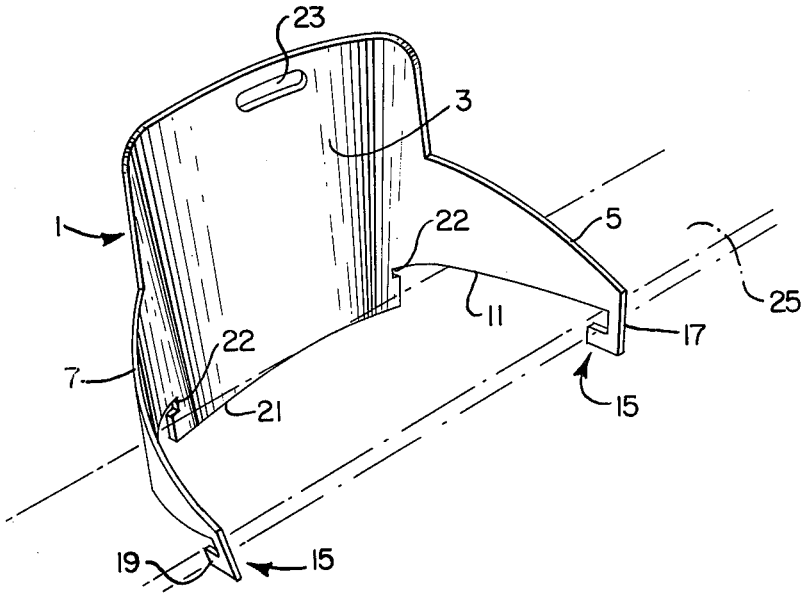
FIG. 4 is a perspective view of the back rest in operative position releasably locked to a bleacher seat.

The user of the back rest who is carrying it in its flat transport and storage position as particularly illustrated in FIG. 1, upon reaching the section of the bleacher seat upon which it is desired to releasably mount the back rest in operative position on a bleacher seat, grasps an arm or panel member 5 and 7 in each hand and bends or shapes the back rest into the position illustrated in phantom lines at E-E in FIG. 3 of the drawings. It will be appreciated, that in this position, the arm or panel members 5 and 7 are brought towards each other against the action of the "memory" of the material from which the back rest is made. When the members 5 and 7 are in the position E-E, they are released and will spread into operative back supporting position illustrated in full lines in FIG. 3. When the arms or panel members 5 and 7 are released and allowed to spread into the full line position of FIG. 3 of the drawings, the dimension C-C of FIG. 3 will equal the dimension B-B of FIG. 1 of the drawings. It will be appreciated that at the time the arm or panel members 5 and 7 are in the position E-E, the seat locking or clamping arrangement 15 will be properly positioned so that when the members 5 and 7 are released, the arrangement 15 will be releasably locked to the bleacher seat 25. In operative position, as particularly disclosed in FIG. 2 of the drawings, the length 17 will extend down along the front edge of the bleacher seat 25 and each clamping foot 19 will extend in operative position beneath the bleacher seat. This spreading action by the members 5 and 7 from phantom line position E-E to full line position of the members 5 and 7, occurs because of the "memory" of the material from which the back rest is made. Since this "memory" constantly exerts a bias on the shaped material, it will be constantly urged into its flat configuration as disclosed in FIG. 1 of the drawings. The spread of the arm members from phantom line position to full line position as disclosed in FIG. 3, will vary according to the width of the bleacher seat 25, the spread will be less on a wide bleacher seat than it will be on a narrow bleacher seat. Thus, the back rest will accommodate itself to bleacher seat widths within a normal range which is encountered in various stadiums and the like where such bleacher seat may be used.

When the back rest has been operatively mounted as illustrated in FIG. 3 of the drawings, it will remain firmly attached to the bleacher seat until the arm or panel members 5 and 7 are bent or brought towards each other to the phantom line position E-E, whereupon the back rest may be raised off the bleacher seat and due to its "memory" it will return to its flat configuration for transport and storage.

It has been my experience that bleacher seats may vary in thickness and the dimension D-D has been so designed and is sufficient to allow the releasable clamping and locking arrangement to fit on the thickest bleacher seat which is commonly encountered. The angle F-F provided by the cut outs, allows the back rest to have a degree of backward tilting movement to increase the comfort of the user thereof and this angle F-F is sufficient so that when the back rest is used on a maximum thickness bleacher seat, it will still tilt backwards sufficiently to insure maximum comfort for the user. It will now be evident that when the back rest is used on the thinnest seat found in stadiums it will tilt backwards the maximum amount and when used on the thickest seat found in stadiums it will tilt backwards the minimum amount. The dimension D-D is such that the back rest will never tilt backwards an excessive amount.

Consideration of FIG. 2 of the drawings, indicates that when the back rest is in operative position, the downwardly depending member or lip 21 will extend behind the bleacher seat 25.

It is significant that the sheet of flexible material is so formed that the various members thereof are all within the planes of the front and rear surfaces of the flexible material when it is in its flat substantially planar configuration. For instance, the releasable clamping and locking means 15 and the depending position 21 are all in the same plane when the sheet of flexible material is in its flat transport and storage condition. It is within my contemplation, if found necessary, to slightly increase the thickness of certain high stress areas in the back rest, for instance, such areas as the releasable clamping and locking means 15. If deemed advantageous to slightly increase the thickness of the back rest thickness in these certain areas, the material would still be of substantially planar configuration when in transport and storage condition, and these areas of slightly increased thickness would be substantially within the planes of the front and rear surfaces of the flexible material.

What is claimed is:

1. A back rest adapted to be releasably locked on a bleacher seat, said back rest composed of a flexible material providing a body portion and a panel member divergently extending from each side edge thereof, forming a substantially uniformly flexible structure, said flexible material, including said panel members, being in substantially planar condition when in its transport and storage state, and said flexible material being bendable into operative back supporting releasably locked position on a bleacher seat, said flexible material having an inherent self-adjusting characteristic whereby it will automatically return to its substantially planar condition when bending pressures thereon are released, and bleacher seat locking and clamping means provided on and extending from each panel, the bleacher seat locking and clamping means being operable to engage and releasably lock said back rest on a bleacher seat when said flexible material is bent, the inherent self-adjusting characteristics of said flexible material releasably urging said means into locking engagement with a bleacher seat, said means includes lengths of said flexible material and a length depends from the outer edge of each panel, and said body portion of said material depends below the lower edges of said panel members, the distance between each of said lengths and each side edge of said depending portion is at least equal to the width of the bleacher seat.

2. A back rest adapted to be releasably locked on a bleacher seat, said back rest composed of a flexible material, and providing a back supporting portion and a panel member divergently extending from each side edge thereof, forming a substantially uniformly flexible structure, said flexible material being bendable into operative position releasably locked on a bleacher seat, gripping feet extending from each panel member and a lip depending from said back supporting portion, said gripping feet and lip adapted to engage and support the back rest on the bleacher seat in back supporting operative condition, and said flexible material having an inherent self-adjusting characteristic constantly urging the flexible material into said back supporting operative condition, the gripping feet moving with the panels when said panels are moved under the influence of the self-adjusting characteristic of said flexible material for releasably holding the gripping feet in engagement with the bleacher seat.

3. A back rest adapted to be releasably locked on a bleacher seat, said back rest composed of a flexible material providing a body portion and a panel member divergently extending from each side edge thereof, forming a substantially uniformly flexible structure, and said flexible material being in substantially planar condition when in its transport and storage state and being bendable into operative back supporting releasably locked position on a bleacher seat, said back rest provided with a bleacher seat locking and clamping means operable to engage and releasably lock said back rest on a bleacher seat, and said flexible material having an inherent self-adjusting characteristic whereby it will automatically return to its substantially planar condition when bending pressures thereon are released and wherein the inherent self-adjusting characteristic of said flexible material releasably urges said means into locking engagement with a bleacher seat, and said back rest including a member depending from said body portion.

4. A back rest adapted to be releasably locked on a bleacher seat, said back rest composed of a flexible material, and providing a back supporting portion and panel members divergently extending from each side edge thereof, said panels being movable with said back supporting portion and in normal usage of the back rest being substantially immovable relative thereto, said flexible material being bendable into operative position releasably locked on a bleacher seat, gripping feet extending from each panel member and a lip depending from said back supporting portion, said gripping feet and lip adapted to engage and support the back rest on the bleacher seat in back supporting operative condition, and said flexible material having an inherent self-adjusting characteristic constantly urging the flexible material into said back supporting operative condition, the gripping feet moving with the panels when said panels are moved under the influence of the self-adjusting characteristic of said flexible material for releasably holding the gripping feet in engagement with the bleacher seat.

* * * * *